US006352290B1

(12) United States Patent
Scottino

(10) Patent No.: US 6,352,290 B1
(45) Date of Patent: Mar. 5, 2002

(54) CHILD SAFETY LOCK

(76) Inventor: Anthony C. Scottino, 24 Sidehill La., Yonkers, NY (US) 10710

( * ) Notice: Subject to any disclaimer, the term of this patent is extended or adjusted under 35 U.S.C. 154(b) by 0 days.

(21) Appl. No.: 09/551,709

(22) Filed: Apr. 18, 2000

(51) Int. Cl.[7] ..... E05C 19/18

(52) U.S. Cl. ..... 292/259 R; 292/DIG. 2; 70/DIG. 65; 70/212

(58) Field of Search ..... 292/259 R, 292, 292/295, 283, 284.338, 339, DIG. 2; 70/212, DIG. 65

(56) References Cited

U.S. PATENT DOCUMENTS

| | | | | | |
|---|---|---|---|---|---|
| 1,455,198 | A | * | 5/1923 | Gibson | 190/13 E |
| 2,784,992 | A | * | 3/1957 | Karjala et al. | 292/162 |
| 2,967,080 | A | * | 1/1961 | Nelson | 312/216 |
| 3,475,929 | A | | 11/1969 | Weingart | 70/14 |
| 3,856,373 | A | * | 12/1974 | Tucich | 312/216 |
| 3,980,326 | A | | 9/1976 | Smith | |
| 4,177,656 | A | | 12/1979 | Davis | 70/84 |
| 4,819,461 | A | * | 4/1989 | Pearson | 70/14 |
| 4,984,833 | A | | 1/1991 | Knurr | 292/96 |
| 5,230,541 | A | | 7/1993 | Nowak | 292/288 |
| D342,885 | S | | 1/1994 | Keller | D8/331 |
| 5,360,243 | A | | 11/1994 | Hirsch | 292/144 |
| 5,988,473 | A | * | 11/1999 | Hagan et al. | 224/404 |
| 6,018,968 | A | * | 2/2000 | Sides | 70/14 |

* cited by examiner

*Primary Examiner*—Anthony Knight
*Assistant Examiner*—Vishal Patel

(57) ABSTRACT

An apparatus comprising modified cabinet doorknobs, a lock shaft and a pressure activated lock for mating with the connecting shaft. The lock shaft fits through the holes in the doorknobs. The lock comprises a housing, spring loaded window or pin, and a spring. When a user presses down on the lock the pin or window would move allowing passage of the lock shaft through the lock. When released, the pin or window would engage the holes, grooves or flanges of the shaft locking the shaft and preventing removal of the shaft from the lock.

10 Claims, 2 Drawing Sheets

CHILD SAFETY LOCK

BACKGROUND OF THE INVENTION

1. Field of the Invention

The present invention relates to an apparatus for securing cabinet doors and specifically to a child safety lock to prevent children from gaining access to cabinets in kitchens and bathrooms.

2. Description of the Prior Art

The prior art discloses a wide variety of cabinet locks and child safety locks. For example, U.S. Pat. No. 5,360,243 discloses an electromagnetic lock with remote treadle for securing cabinets. U.S. Pat. No. 5,230,541 discloses a cabinet fastener with a flexible elongated band for securing paired handles of a cabinet. U.S. Pat. No. 4,984,833 discloses a lock hook for a door of a computer cabinet. U.S. Pat. No. 4,177,656 discloses a heavy duty cabinet lock. U.S. Pat. No. 3,475,929 discloses a portable locking device which requires a padlock. What is needed beyond the prior art is a child safety lock of simple and inexpensive design.

SUMMARY OF THE INVENTION

The present invention meets the needs and solves the problems identified above by providing an apparatus comprising modified cabinet doorknobs, a lock shaft and a pressure activated lock for mating with the connecting shaft. The modified cabinet doorknobs replace the existing doorknobs. In some cases, existing doorknobs may be altered to meet the requirements of the modified doorknobs. The modified doorknobs each have a knob shaft of a first diameter and a knob of a second diameter. The second diameter will always be larger than the first diameter. Each modified doorknob has a ¼ inch hole running horizontally through the center shaft of the doorknob and parallel to the surface of the cabinet to which the doorknobs are to be attached. A typical doorknob has a knob of approximately 1 inch diameter and a shaft 3 ¼ inches long and ⅜ inch diameter. The modified doorknobs may be secured to the cabinet by a variety of means. In the preferred embodiment, the modified doorknobs are secured to the cabinet by 1¼ inch screws. A washer may be placed between the doorknob shaft and the cabinet door.

A lock shaft fits through the holes in the doorknobs. In the preferred embodiment, the lock shaft measures approximately 8 inches in length by 3/16 inch in diameter and is made of plastic. The lock shaft has a first end to which a cross bar is affixed to prevent the lock shaft from passing completely through the holes. The lock shaft second end is rounded to facilitate passage through the holes. The cross bar is approximately 1 inch long. In the preferred embodiment, the lock shaft is approximately 8 inches long. In the preferred embodiment, the body of the lock shaft from the approximate center to the lock shaft second end has holes for receiving a spring loaded locking pin contained in the lock. Alternatively, the lock shaft may have grooves in the shaft for mating with a spring loaded window in the lock where the grooves are located from the approximate center to the second end may has holes for receiving a locking pin in the lock. Further in the alternative, the locking shaft may have circular flanges extending outward for mating with a spring loaded window in the lock where the flanges are located from the approximate center of the shaft to the second end.

The lock comprises a housing, a pin and a spring. Alternatively, the lock comprises a housing, an aperture and a spring. When a user presses down on the lock, the pin moves allowing passage of the lock shaft through the lock. When released, the pin engages the holes. Alternatively, the aperture engages the grooves or flanges of the lock shaft locking the shaft and preventing removal of the shaft from the lock. In the preferred embodiment, the housing measures approximately ¾ inch by ¾ inch.

To employ the lock, the user removes the existing doorknobs and replaces the doorknobs with modified doorknobs. To lock the cabinets, the user slides the second end of the lock shaft through the holes in the doorknobs until the lock shaft second end is completely through both doorknobs. The lock, with the spring depressed, is then slid over the second end of the lock shaft until the second end of the lock shaft is through the lock. The spring is then released so that the pin engages the holes, or alternatively, the aperture engages the grooves or flanges.

In an alternate embodiment, the lock shaft may be made approximately 12 to 14 inches long for use on single cabinets with drawers above the cabinet. The longer lock shaft would allow the lock to be used to pass through the single cabinet doorknob and the handle or knob of the drawer above the cabinet.

The foregoing and other objects, features and advantages of the invention will be apparent from the following more particular description of a preferred embodiment of the invention, as illustrated in the accompanying drawings wherein like reference numbers represent like parts of the invention.

DESCRIPTION OF PREFERRED EMBODIMENTS

Figure 1:
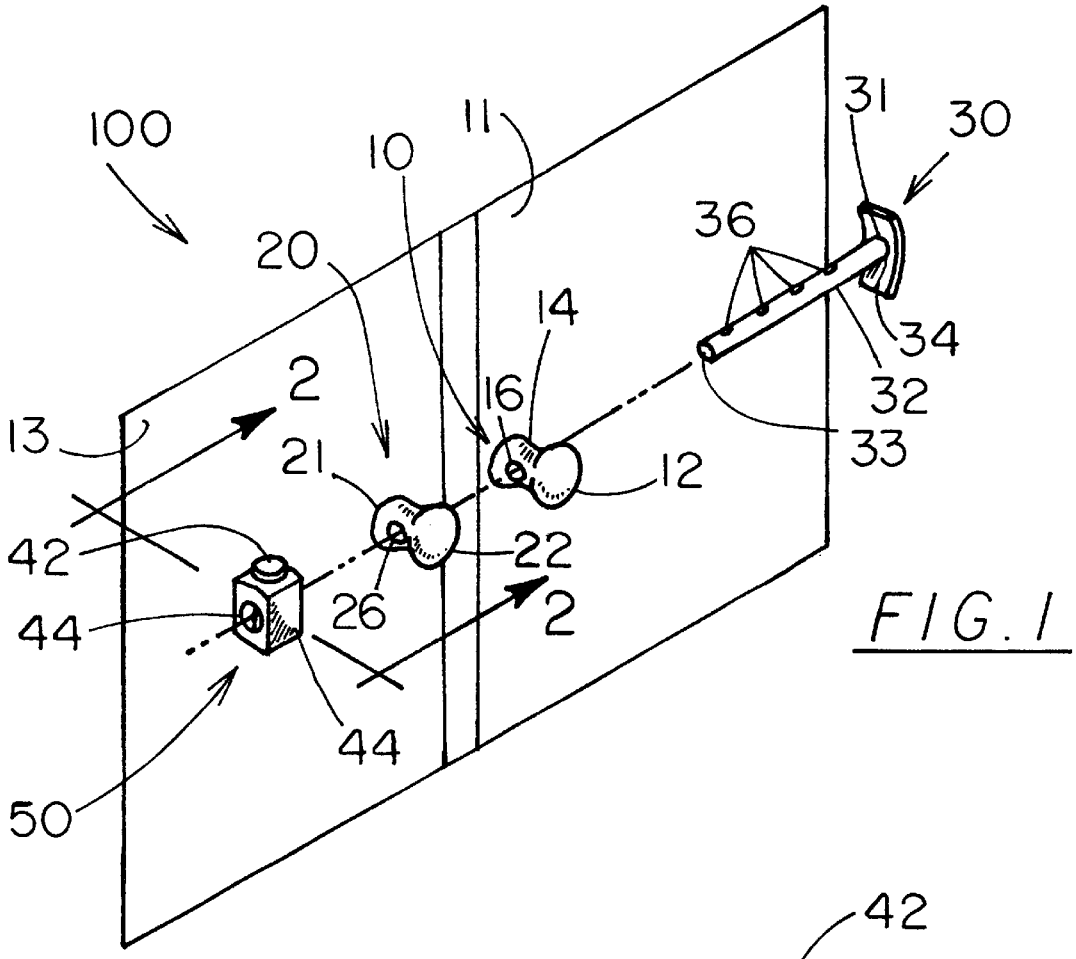
FIG. 1 is a left side perspective view of the invention

FIG. 1 depicts device 100 having first doorknob 10, second doorknob 20, shaft 30 and lock 50. First doorknob 10 is fastened to first door 11 and second doorknob 20 is fastened to second door 13. First doorknob 10 and second doorknob 20 may be original doorknobs that have been modified or they may be doorknobs included as part of device 100. In the preferred embodiment, doorknobs 10 and doorknobs 20 replace the original doorknobs.

First doorknob 10 has first knob shaft 14 and first knob 12. First knob shaft 14 has first knob hole 16 running horizontally through the center of first knob shaft 14 parallel to the surface of first door 11. First knob 14 has a diameter of approximately 1 inch and first knob shaft 14 has a length of 3¼ inches long and a diameter of approximately ⅜ inch. A washer may be placed between first knob shaft 14 and first door 11. In the preferred embodiment, first doorknob 10 may be affixed to first door 11 by 1¼ inch screws.

Second doorknob 20 has second knob shaft 24 and second knob 22. Second knob shaft 24 has second knob hole 26 running horizontally through the center of second knob shaft 24 parallel to the surface of second door 13. Second knob 24 has a diameter of approximately 1 inch and second knob shaft 24 has a length of 3¼ inches long and a diameter of approximately ⅜ inch. A washer may be placed between second knob shaft 24 and second door 11. In the preferred embodiment, second doorknob 20 may be affixed to second door 13 by 1¼ inch screws.

Shaft 30 has shaft body 32 having shaft body first end 31 and shaft body second end 33. Endplate 34 is fixedly attached to shaft body first end 31. Shaft body 32 has a plurality of shaft holes 36. Alternatively, shaft holes 36 may be grooves. Further in the alternative, shaft holes 36 may be protruding flanges capable of passing through first knob hole 16 and second knob hole 26. Shaft body second end 33 is inserted through first knob hole 16 and second knob hole 26 until shaft holes 36 appear and endplate 34 is near or contacting first knob shaft 14. Lock shaft second end 33 is then inserted through lock aperture 44 until lock 50 is secured to knob shaft 32. In the preferred embodiment, the lock shaft measures approximately 8 inches in length by 3/16 inch in diameter and is made of plastic. Lock shaft second end 33 is rounded to facilitate passage through the holes. The cross bar is approximately 1 inch long.

Figure 2:
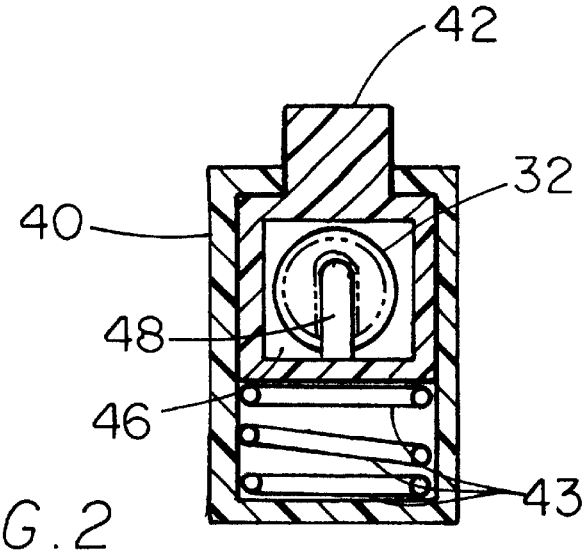
FIG. 2 is a cross sectional view of along line 2—2 of FIG. 1.

Referring to FIG. 2, lock 50 has lock housing 40, lock button 42 and lock aperture 44. Lock housing 40 contains lock button 42 and spring 43. Lock button 42 has an interior compartment which is slidingly engaged inside lock housing 40. Spring 43 is encased in lock housing 40 beneath lock button 42 so that lock button 42 is forced upward to rest against the top of the inner compartment of lock housing 40. A smaller upper portion of lock button 42 protrudes through an opening the top of lock housing 40. In FIG. 2 lock button 42 has pin 48 inside lock button cavity 46. Pin 48 engages holes 36 in lock shaft 32. When lock button 42 is depressed spring 43 is depressed and pin 48 moves downward allowing passage of lock shaft 32 through lock aperture 44. When lock button 42 is released, spring 43 forces lock button 42 upward and pin 48 moves upward inside the inner compartment of lock button 42. Alternatively, lock button 42 may contain a window with a larger diameter than lock shaft 33 so that when lock shaft 33 is inserted through lock aperture 44 and lock button 42 is released the window inside lock button 42 engages grooves in lock shaft 32. Further in the alternative, the window in lock button 42 may engage ridges on lock shaft 32.

Figure 3:
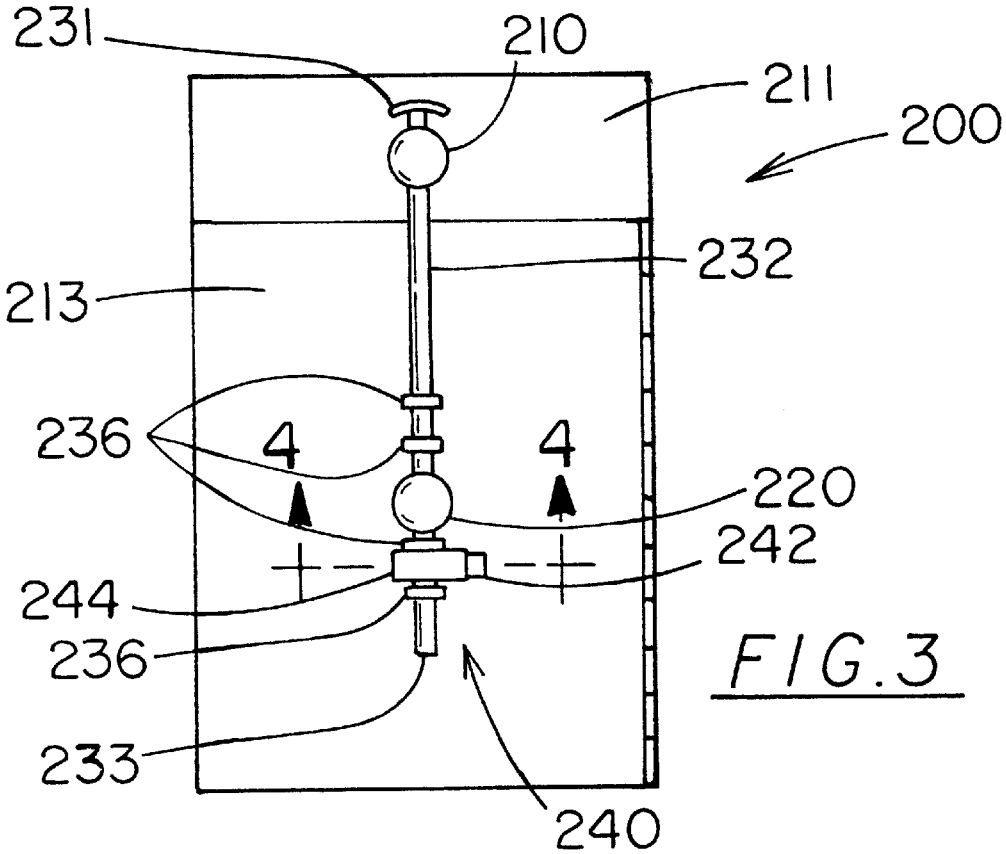
FIG. 3 is a front view of an alternate embodiment of the invention.
Figure 4:
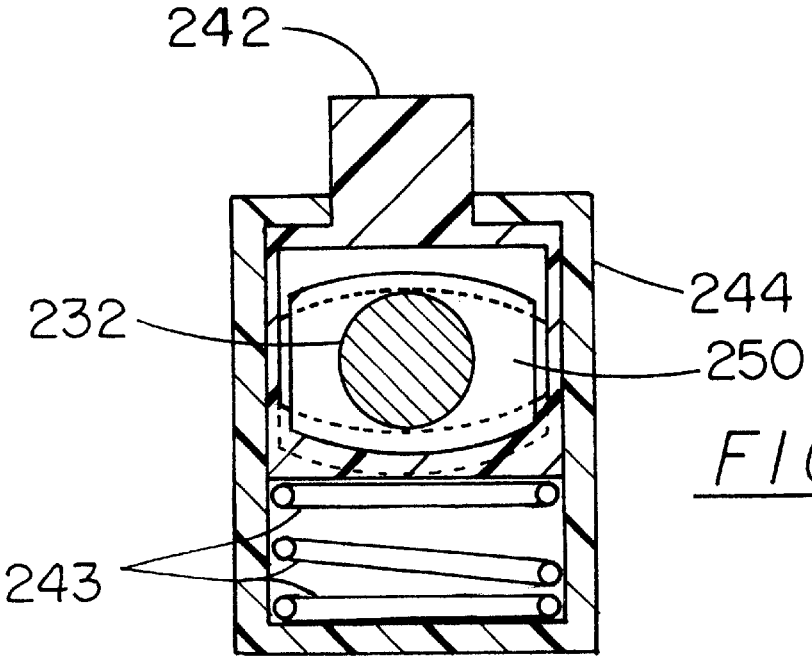
FIG. 4 is cross section along line 2—2 of FIG. 1 of an alternate lock mechanism.

FIG. 3 depicts an alternative embodiment of device 100 in FIG. 1. Device 200 is used for a single cabinet door with a drawer above the single cabinet drawer. In FIG. 3, Third door 213 is positioned beneath drawer 211. Third knob 210 is affixed to drawer 211. Fourth knob 220 is affixed to third door 213. Second lock shaft 232 has a plurality of flanges 236 with diameter less than the diameter of the holes in third knob shaft (not shown) and fourth knob shaft (not shown). Second lock shaft 232 is passed down through the hole in third knob 210 and through the hole in fourth knob 220. Second lock button 242 is depressed which causes second spring 243 to be depressed and second lock 240 is inserted over second lock shaft second end 33 and one or more of flanges 236. When second lock 240 is in the desired position, second lock button 242 is released and spring 243 forces lock button 242 upward until the lock button 242 rests against the interior of second lock housing 244. Flanges 236 now cannot pass through the aperture of lock 240. Second door 213 is now locked.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

I claim:

1. A cabinet locking system comprising:

a pair of cabinet knobs each having a shaft with a circular hole extending through said shaft;

a lock shaft having a first end and a second end;

a plurality of locking devices on said lock shaft; and a lock having an aperture and a lock button;

wherein, when said second end is placed through said circular holes of said pair of cabinet knobs, said lock secures said lock shaft in said cabinet knobs.

2. The lock of claim 1 further comprising a lock housing and a lock spring.

3. The lock button of claim 1 further comprising a pin.

4. The lock button of claim 1 further comprising a window.

5. The lock shaft of claim 1 further comprising a plurality of holes.

6. The lock shaft of claim 1 further comprising a plurality of grooves.

7. The lock shaft of claim 1 further comprising a plurality of flanges.

8. A drawer locking system comprising:

a cabinet knob having a cabinet knob shaft with a first circular hole extending through the cabinet knob shaft;

a drawer knob having a drawer knob shaft with a second circular hole extending through the drawer knob shaft;

a lock shaft having a first end and a second end;

a plurality of locking devices on the lock shaft; and a lock having an aperture and a lock button;

wherein, when said second end is placed through said first circular hole and second circular hole, said lock secures the lock shaft in said cabinet knob and said drawer knob.

9. The lock button of claim 3 further comprising a window.

10. The lock shaft of claim 8 further comprising a plurality of flanges.

* * * * *